United States Patent [19]

Grover et al.

[11] 4,156,988

[45] Jun. 5, 1979

[54] AIR-WATER SEALING SYSTEM FOR METAL WINDOWS AND OTHER IMPROVEMENTS

[75] Inventors: R. Kumar Grover, Mountlake Terrace; Waldo C. Erickson, Bothell, both of Wash.

[73] Assignee: Fentron Industries, Inc., Seattle, Wash.

[21] Appl. No.: 848,244

[22] Filed: Nov. 3, 1977

[51] Int. Cl.[2] ..... E05D 15/00; E06B 3/34

[52] U.S. Cl. ..... 49/390; 49/408; 49/494; 49/504; 52/397

[58] Field of Search ..... 49/390, 388, 392, 393, 49/394, 383, 408, 504; 52/399, 397, 398, 401, 400; 16/128 R, 161, 137

[56] References Cited

U.S. PATENT DOCUMENTS

| | | | |
|---|---|---|---|
| 1,849,780 | 3/1932 | Albright | 49/392 X |
| 2,166,870 | 7/1939 | Livesay | 49/504 X |
| 2,504,635 | 4/1950 | Bradley | 16/137 |
| 2,718,079 | 9/1955 | Strey | 49/394 X |
| 2,902,729 | 9/1959 | Gillespie | 49/394 X |
| 3,016,993 | 1/1962 | Owen | 52/398 X |
| 3,443,624 | 5/1969 | Toth | 49/390 X |
| 3,553,985 | 1/1971 | Pepp, Jr. et al. | 49/388 X |
| 3,691,713 | 9/1972 | Dulaney | 52/397 |
| 3,815,285 | 6/1974 | Kuyper | 49/504 X |

*Primary Examiner*—Philip C. Kannan

*Attorney, Agent, or Firm*—Seed, Berry, Vernon & Baynham

[57] ABSTRACT

An extruded aluminum window is provided with outer frame members for fastening to the building and inner frame members for fastening and holding one or more glass panes. The frames are provided with a sealing system which while allowing pressure equalization prevents air and moisture from passing into the interior of the structure when the window is closed. The sealing system includes an external water deterrent and a pair of internal sealing members with the frame between the external deterrent and the internal sealing members having a water barrier formed with a plurality of serrations each in a plane parallel to the frames. The sill of the outer window frame is provided with internal and external upwardly extending legs, and a raised central portion which joins the external leg in a recessed gutter to drain water out through slots in the external leg. In one embodiment the window can pivot a full 180° with seals being provided to prevent air from leaking through the pivot connections when the window is closed. A glazing bead is provided with legs which can snap into the outer window frame offset from the plane of the glass and at its other end forms a snap-in seal as part of the internal sealing means. In one embodiment the internal frame can be pivoted 180° with a self-latching lock holding the movable frame in an open cleaning position.

12 Claims, 8 Drawing Figures

AIR-WATER SEALING SYSTEM FOR METAL WINDOWS AND OTHER IMPROVEMENTS

BACKGROUND OF THE INVENTION

Field of the Invention

This invention pertains to metal window frames, particularly extruded aluminum window frames, and to features of those frames which improve its performance, that is, air and water sealing integrity, and to improve cost and assembly benefits.

SUMMARY OF THE INVENTION

It is an object of this invention to provide metal window frames which are more secure in their ability to prevent the ingress of air and water past the window frames into the building.

It is another object of this invention to provide an aluminum extruded glazing bead that is easy to snap-in-place and provides a sealing mechanism offset from the pane of the glass.

It is another object of this invention to provide a 180° pivotal window which is self-latching in a fully reversed cleaning position.

It is another object of this invention to provide a barrier in an aluminum extruded window frame that prevents the free flow of moisture transversely to the pane of the glass so that water does not reach the internal seals of the window frame.

It is another object of this invention to provide an aluminum extruded window frame in which the sill of the outer frame has a moisture collecting gutter along its length.

It is still another object of this invention to provide a sealing means at the pivot of 180° pivotable window to prevent leakage of air around the pivot when the window is closed.

It is still another object of this invention to provide a combined sealing and latching member for a snap-in glazing bead.

Basically, some of these objects are obtained in a system or combination of several features to provide a total high performance system. In addition, some of the features are obtained by individual employment of the feature in windows not utilizing the sealing system. The high performance integrity against air and water leakage is obtained by the use of equal pressurization, that is free passage of external air into the spaces between the outer and inner window frames, an external water deterrent which restricts much of the water that can pass into the equal pressurization area, a water barrier which restricts the free flow or migration of water toward the internal seals, and effective internal seals to prevent any moisture and air which does reach the internal surfaces of the frames from passing between the frames to the interior of the building. In one embodiment the deterrent is an overlap between the peripheral inner frame in which the glass pane is mounted and the external frame which is secured in the building. In another embodiment the external water deterrent is a flexible strip or seal carried by the outer frame member and slidably engaged with the inner frame member.

The water barrier, however, is in itself unique for other window and sealing system applications and basically includes a plurality of serrations or grooves running parallel to the plane of the window frame and thus perpendicular to the migrational path of water from the exterior toward the interior surfaces of the window frame. The serrations force the water in uneven paths overcoming the surface tension of the water to allow gravity to cause the water to drip toward a gutter at the lower part of the frame.

A unique glazing bead is provided to snap-in to the inner window frame which carries the glass plane. The glazing bead has opposite ends which are resiliently deformable with the ends being snapped into notches in the inner frame. One of the notches at the interior surface of the window frame is provided with a cylindrical seal that is compressed by one of the latching surfaces on the nib of the glazing bead.

The pivots for the 180° pivotable window are sealed separately from the remainder of the window frame to prevent leakage of air around the pivot and a self-latching lock in the form of a spring biased detent holds the inner window frame in its open cleaning position.

DETAILED DESCRIPTION OF THE PREFERRED EMBODIMENTS

Figure 1:
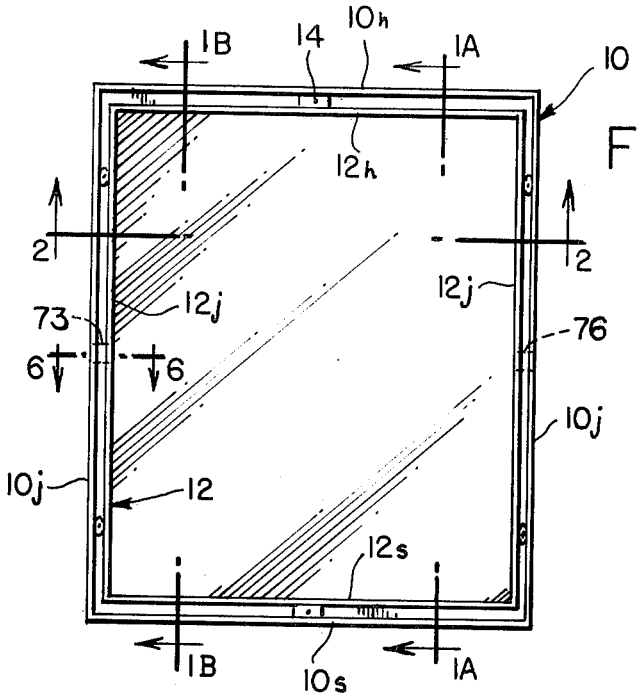
FIG. 1 is a front elevation of a typical pivoted window embodying the principles of the invention.

The window shown in FIG. 1 is illustrated as being a 180° pivotal window, however, the details of the unique frame structure and sealing system are applicable to hinge, case-ment, 360° rotatable, etc., window frames and will be used for discussion and description of common features for illustrative purposes and brevity only. The embodiment shown in FIG. 3, for example, is a typical hinged window construction and as will be explained differs only slightly in principles of operation from that of the 180° pivotal window. The windows are each provided with an outer frame 10 comprising jambs **10*j*, a head frame 10*h* and a sill 10*s*. An inner frame 12 is also provided with inner jambs 12*j*, a head 12*h* and a sill 12*s*. In FIG. 1 the inner frame is joined to the outer frame by a pair of opposed pivots 14 whereas in the embodiment of FIG. 3 the inner frame is joined to the outer frame by conventional hinge links 16**. In describing the frames the designation exterior will mean the outside of the building, interior the inside of the building; outer being the direction in the plane of the window toward the building opening surrounding the frames and inner toward the direction of the center of the glass pane.

Figure 1A:
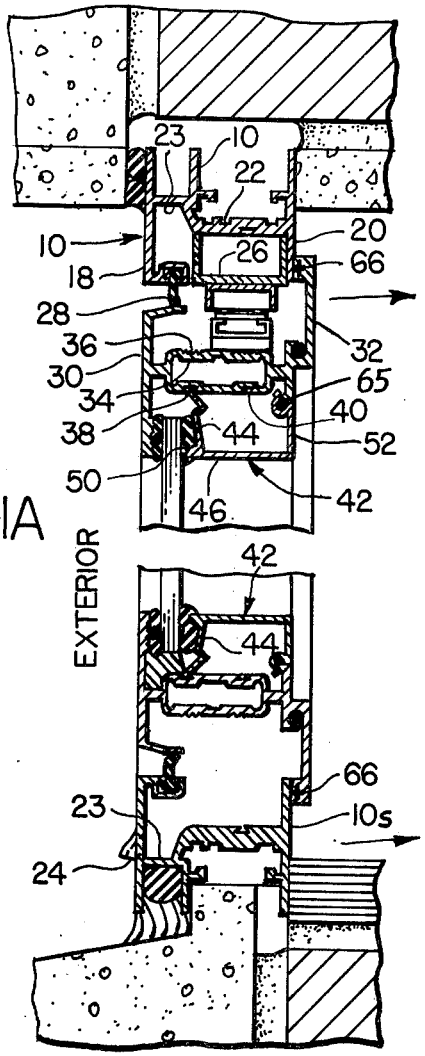
FIG. 1A is a section taken along the line 1A—1A of FIG. 1.
Figure 1B:
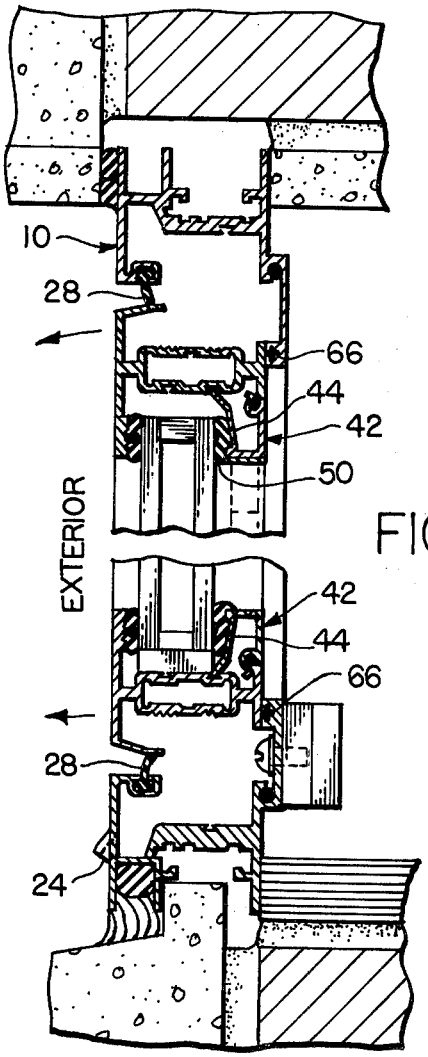
FIG. 1B is a section taken along the line 1B—1B of FIG. 1.

Each of the head, jambs and sill frames are similar in the outer frame 10. These frames include an exterior inwardly directed leg 18 and an interior inwardly directed leg 20. The frames also include a raised central portion 22 which is joined to the exterior leg by a recess 23. As best shown in FIG. 1*a* the sill 10*s* is provided with slots 24 which communicate with the recess 23 allowing the recess to serve as a collecting device or water gutter and pass the water back to the exterior. If desired, conventional "Anderberg" releasable limit opening safety hardware 26 can be attached to the frame 10*h*. As is readily understood, the common cross-sectional shape of each of the frame members making up the outer frame provides a cost savings during the manufacture and inventory of window parts.

In the embodiment of the 180° pivotal window the leg 18 is provided with a flexible sealing strip or exterior water deterrent 28 which engages the inner frame to impede the passage of water in between the frames but is not sufficiently tight to affect the equal pressurization between the frames.

The inner frame 12 is also provided with similar cross-sectional shapes in the head, jambs and sill and includes an exterior leg 30 extending outwardly into engagement with the water deterrent 28, an interior leg 32 extending outwardly into overlapping engagement with the leg 20 of the outer frame. (The frames are different in the location on the inner and outer frames of the interior leg 32 and 20 to allow for pivoting of the inner frame). The inner frame is also provided with a raised central portion 34 having a plurality of grooves or serrations 36 which run along the central portion in planes parallel to the plane of the window panes. These serrations, particularly at the sill 12*s* cause the water to travel in a tortuous or uneven path so that droplets are formed which fall by gravity rather than cling to and migrate along the surfaces of the central portions.

Figure 5:
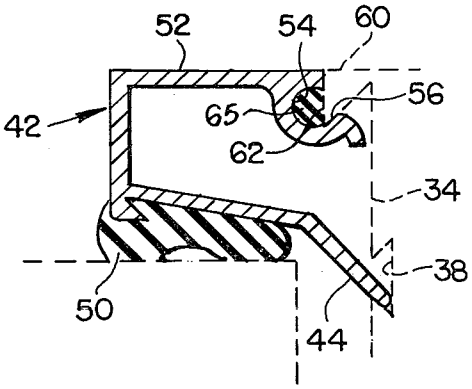
FIG. 5 is a fragmentary detail of one of the glazing beads embodying the principles of the invention.
Figure 4:
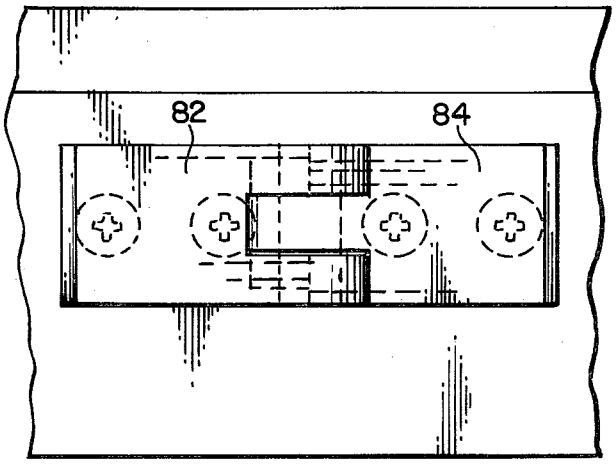
FIG. 4 is a fragmentary front elevation looking toward the interior of the pivot shown in FIG. 2.

The central portions are also provided with sets of notches 38 and 40 which hold a glazing bead 42. The notch 38 is designed to be used with a single pane whereas the notch 40 will be used with a double or insulated pane. The glazing bead is provided with an exterior leg 44 which snaps into the groove 38, a central portion 46 that presses against a standard window seal 50 and an interior leg 52 that is provided with a recess 54 and a locking edge 56 (FIG. 5). The inner frame is also provided with an outwardly extending nib 60 having a seal compressing surface 62. The legs of the glazing bead 42 are resiliently deformable so that the glazing bead can compress the seal 50 and hold itself within the notch 38 and with the locking edge 56 hooked over the nib 60. In this position a standard o-ring 65 is compressed within the recess 54 to provide an inner sealing means. As best shown in FIG. 1A the glazing bead exterior leg 44 terminates offset from the plane of the glass so that it neither interferes with any of the mounting members for the glass nor will get bonded by the glazing or sealant used to hold the glass within the pane. This is an advantage as it avoids having to damage the sealant during repair of the glazing bead or glass pane and avoids edge chipping of the glass during installation.

The interior legs 20 and 32 are sealed by a conventional interior seal 66.

Figure 6:
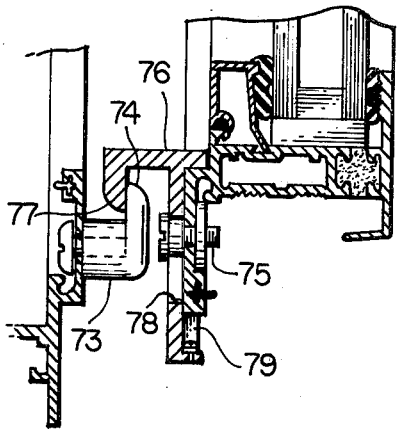
FIG. 6 is a fragmentary elevation showing a spring-closed latch employed in the pivotal window shown in FIG. 2.
Figure 2:
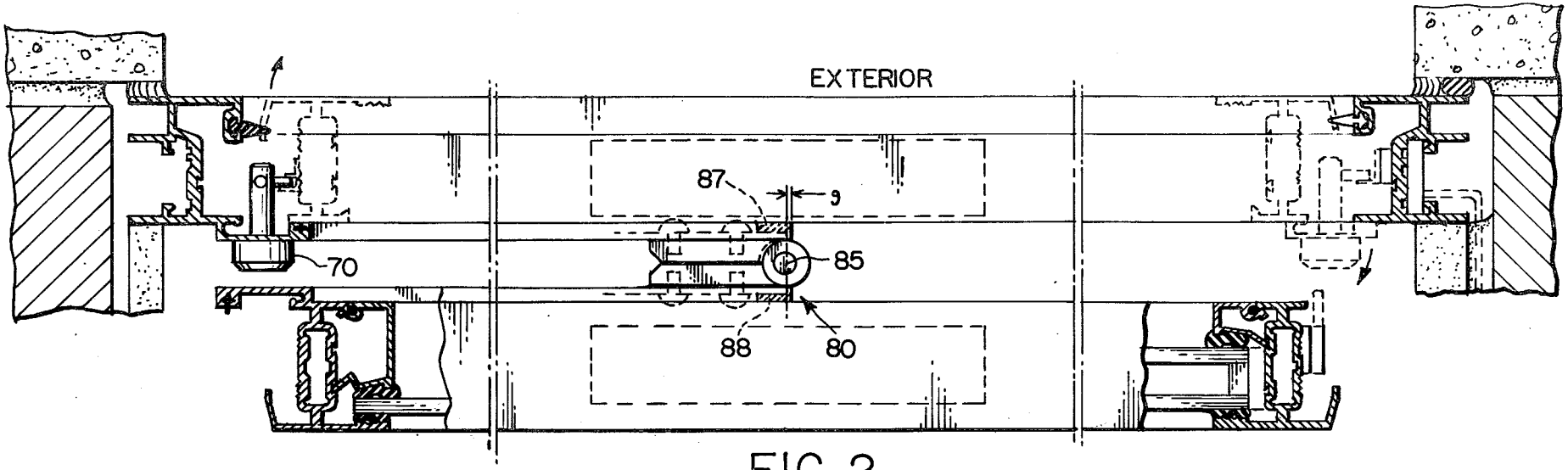
FIG. 2 is a section taken along the line 2—2 of FIG. 1.

As best shown in FIGS. 2 and 6, the 180° reversible window is locked in its closed position by conventional latches 70 and is automatically locked in its open ventilating position as shown in FIG. 2 by gravity-controlled latches (for horizontally pivoted windows) or preferably by spring-biased latches as will now be described. The automatic latch includes a catch 73 having a beveled inner surface 74. The movable frame is provided with a dog 76 having a beveled outer surface 77. The dog is slidably mounted on a pin 75 which rides in a slot 78. A leaf spring 79 presses the dog outwardly. As the movable frame reaches its full 180° position it can be seen that the two beveled surfaces will cause the dog to automatically retract and then hook to the latch until released.

The 180° reversible window is also provided with pivot members 80 formed on a bracket 82 which is secured to the outer frame and a bracket 84 which is secured on either side of the interior surface of the inner frame. Pivot pins 85 join the two sets of brackets. As is best illustrated in FIG. 2 the axis of rotation of the pins is offset laterally and inwardly from the plane of the outer frame so that the inner frame can make a full 180° revolution coming to rest in its self-locking position in parallelism with the outer frame. This provides a complete circumferential air gap between the inner and outer frames allowing the window to serve for washing as well as for ventilating purposes. In addition, the brackets are each provided with a sealing bar 87 and 88 of a resilient sealing material. The sealing material each extends a distance g beyond the axis of rotation of the pivots so that as the two sealing pieces 87 and 88 come into engagement with one another as the window is closed a tight compression seal results preventing leakage of air or moisture to the interior at the pivot joint.

Figure 3:
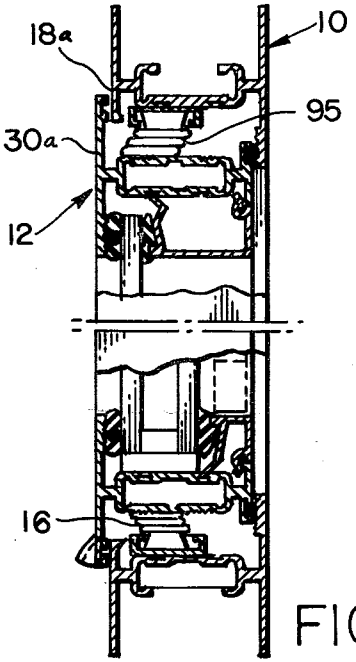
FIG. 3 is a fragmentary vertical section of another form of window frame embodying the principles of the invention.

The embodiment illustrated in FIG. 3 also incorporates all of the features of the earlier described embodiment, but as a substitute for the flexible water deterrent 28 the inner frame 12 is provided with an exterior leg 30*a* which overlaps the exterior leg 18*a* of the outer frame 10. This overlap itself provides a water deterrent without inhibiting passage of air for equal pressurization of the gap between the inner and outer frames. Conventional hinge bars 95 secure this form of inner window to the outer window in a conventional manner. Essentially this embodiment is basically the same in principles as is the other embodiment with the upper half of FIG. 3 illustrating a typical single pane window and the bottom half of FIG. 3 illustrating a typical double pane installation. The principles of the serrations for water barrier, and glazing bead with the two internal sealing means is substantially identical with that of the embodiment previously described and will not be further described.

While the preferred embodiments of the invention have been illustrated and described it should be understood that variations will be apparent to one skilled in the art without departing from the principles herein. Accordingly, the invention is not to be limited to the specific embodiments as illustrated in the drawing.

We claim:

1. An air-water sealing system for metal windows of the type having fabricated inner and outer frames each having jambs, head and sill and one or more glass panes for precluding entry of exterior air to the interior of a building comprising:

an outer peripheral frame encircling the glass pane and joined to a window opening, an inner peripheral frame encircling a glass pane and having an exterior leg extending outwardly toward said outer peripheral frame, an interior leg extending outwardly toward said outer peripheral frame and spaced from said exterior leg, and an elongated body integral with said legs, a pressure equalized air space between the inner and outer peripheral frames open to said exterior air, means joining the inner and outer frames for movement relative to one another, first interior resilient air sealing means for sealing between the interior leg of said inner peripheral frame and said outer peripheral frame to seal said pressure equalized air space from the interior of the building, a glazing bead having one end releasably secured to said elongated body and a second end joined to said interior leg of said inner peripheral frame, second interior resilient air sealing means for sealing between the glazing bead and said interior leg of said inner peripheral frame to seal said pressure equalized air space from the interior of the building, and air pressure equalization openings in said outer peripheral frame for allowing exterior air to penetrate into said pressure equalized space between said frames but with such air being blocked by said first and second interior sealing means from the interior of the building.

2. The system of claim 1, wherein said exterior leg of said inner peripheral frame overlaps said outer peripheral frame, said overlap providing a deterrent to entry of water between said frames.

3. The system of claim 1, wherein said elongated body includes upper and lower horizontal surfaces, said horizontal surfaces having a plurality of parallel serrations terminating in elongated edges defined by converging planes and running parallel to said exterior leg for providing a barrier to movement of water toward said first and second interior sealing means.

4. The system of claim 1, said outer peripheral frame including an elongated body having an exterior recessed channel, the lower sill of said recessed channel forming a gutter for collecting water, and drain ports for emptying said gutter to the exterior.

5. The system of claim 1, said inner and outer frame joining means including hinges.

6. The system of claim 1, wherein said exterior leg of said inner peripheral frame terminates short of and opposed to said outer peripheral frame, and including a flexible strip slidable against said exterior leg for providing a deterrent to entry of water between said frames.

7. The system of claim 3, said inner and outer frame joining means including opposed pivot members supporting the inner frame for pivotal movement between a closed position and a washing position parallel to and offset from said outer frame, first latching means for holding the inner frame in a closed position, and second automatically set latching means for holding said inner frame in said cleaning position.

8. The system of claim 7, said pivot members each including a bracket secured to its respective frame and an opposed end, and including pivot sealing members abutting one another along a line at the juncture of said bracket opposed ends to seal against air leakage at the pivot members.

9. The system of claim 1, said elongated body of said inner frame having a notch, said one end of said glazing bead being seated within said notch, said glazing bead being seated within said notch, said glazing bead having a central portion, a glass pane seal, said central portion pressing said glass pane seal against the pane, said second end of said glazing bead including a seal recess having a locking edge, said second sealing means including a seal within said seal recess, said interior leg of said inner frame including a locking nib seated in said locking edge and having a seal compressing surface, and wherein said glazing bead is resiliently deformable for forcing said locking nib into locking engagement with said locking edge while simultaneously compressing a seal within said seal recess.

10. The system of claim 8, said inner frame notch for receiving said glazing bead first end being located laterally offset from the glass pane to avoid interference from below the pane.

11. A water barrier for glass contained metal window frames to restrict flow of water from exterior to interior of the frames comprising:

a peripheral outer frame having a transverse central surface, a peripheral inner frame holding a glass pane and having a transverse central surface, a pressure equalized space open to the air exterior of said frames between said peripheral outer and inner frames, air sealing means sealing the interior of the inner and outer peripheral frames from the pressure equalized space between said inner and outer peripheral frames, groove means on said inner frame central surfaces for restricting the free flow of water transversely across said surfaces said groove means including a series of parallel serrations each terminating in an elongated edge defined by downwardly converging planes with the edges each lying in planes parallel to the plane of the window frames.

12. A metal window outer frame having head, sill and opposed jambs frame members surrounding a pressure equalized air space open to the exterior air, and an inner window frame sealed from said pressure equalized air space to the interior of a building by air seals, said sill outer frame member including an interior upwardly extending leg, an upwardly extending exterior leg, a raised central portion joining said interior leg, and an elongated depression adjacent said exterior leg for forming a gutter, said depression having a generally vertical wall joining said raised central portion and forming a barrier against moisture splashing from said depression toward said air seals, and openings in said exterior leg joining said depression for draining water out of said depression.

* * * * *